United States Patent [19]

Ragon et al.

[11] 4,202,713

[45] May 13, 1980

[54] UNIT CHARGES OF PROPELLANT POWDER

[75] Inventors: Philippe R. Ragon, Soisy sur Seine; Gerard Van Vooren, Elbeuf, both of France

[73] Assignee: Societe Nationale des Poudres et Explosifs, Paris, France

[21] Appl. No.: 860,325

[22] Filed: Dec. 14, 1977

[30] Foreign Application Priority Data

Dec. 20, 1976 [FR] France ..... 76 38326

[51] Int. Cl.[2] ..... C06B 25/20

[52] U.S. Cl. ..... 149/100; 149/2

[58] Field of Search ..... 149/100, 96, 2; 264/3 C

[56] References Cited

U.S. PATENT DOCUMENTS

| | | | |
|---|---|---|---|
| 3,346,675 | 10/1967 | Sapiego | 149/96 X |
| 3,646,174 | 2/1972 | Macri | 264/3 C |
| 3,655,836 | 4/1972 | Dehm et al. | 149/96 X |
| 3,676,533 | 7/1972 | Dehm et al. | 149/96 X |

*Primary Examiner*—Stephen J. Lechert, Jr.

*Attorney, Agent, or Firm*—Bucknam and Archer

[57] ABSTRACT

A unit charge of propellant powder, particularly suitable for ammunition for small and medium caliber arms, consisting of grains of nitrocellulose powder agglomerated together by means of a gelatinizing plasticizer for nitrocellulose, which plasticizer is liquid at a temperature of up to 80° C. and is present in an amount not exceeding 7% based on the weight of the nitrocellulose.

The charge has virtually the same potential energy as loose nitrocellulose powder and it also fragments and burns instantly, like a loose powder.

11 Claims, No Drawings

UNIT CHARGES OF PROPELLANT POWDER

The present invention is concerned with unit charges of propellant powder which are particularly suitable for small and medium calibre arms, and a method of producing such charges.

It has previously been proposed to compress grains of nitrocellulose powder into small blocks in the presence of an inert thermosetting binder, such as a polyurethane, so as to increase the amount of propellant in a given volume of charge and so as to form caseless ammunition, if desired.

The use of a thermosetting binder involves problems in manufacture, since the slightest variation in weight proportions of the mixture of powder and binder used to make the charge leads to a variation in ballistic performance, and in storage, since the dimensional stability of the charge is inadequate under the severe heat conditions under which it is used and stored, which has a significant effect on the ballistic properties.

Furthermore, where a short compression cycle is desired, it is necessary to use thermosetting binders which have the disadvantage of having a relatively short pot life at 20° C., which restricts their industrial value.

It has also been proposed to agglomerate nitrocellulose powder grains by means of nitroglycerine, which is a powerful plasticiser for nitrocellulose, but a large amount of nitroglycerine (from 20 to 50% based on the weight of nitrocellulose) is needed. It is known that nitroglycerine tends to migrate from the interior of the charge to the periphery thereof. Not only does this migration cause variation in composition and hence impaired ballistic performance, but also minute droplets of nitroglycerine which migrate to the outside of the charge give rise to the danger of detonation at the slightest shock. In addition, powders containing nitroglycerine are too powerful and too live, and are excessively erosive.

We have now developed a unit charge of propellant powder consisting of grains of nitrocellulose powder agglomerated together, which does not exhibit the above-mentioned disadvantages.

According to the invention, there is provided a unit charge of propellant powder, which comprises grains of nitrocellulose powder agglomerated together by means of a gelatinising plasticiser for nitrocellulose, which plasticiser has a melting point of up to 80° C. and is present in an amount not exceeding 7% based on the weight of nitrocellulose.

A gelatinising plasticiser not only plasticises the nitrocellulose at ambient temperatures, but also causes the ordered structure of the nitrocellulose to disappear irreversibly at an elevated temperature (such as from 40° to 100° C.).

Suitable such gelatinising plasticisers include, for example:

(a) low molecular weight esters of glycerol, such as glycerol acetate, glycerol diacetate or glycerol triacetate, which are also known as monoacetin, diacetin and triacetin, respectively, (b) polyesters of a short-chain alcohol, comprising free hydroxyl groups and having a molecular weight less than 1,500, such as a polyadipate or polysuccinate of a short-chain alcohol, (c) organic carbonates, such as a mixed carbonate of allyl alcohol and diethylene glycol, of the formula $$O-(-CH_2-CH_2O-\underset{\underset{O}{\|}}{C}-O-CH_2-CH{=}CH_2)_2$$

and (d) telechelic aliphatic diisocyanates, such as hexamethylene diisocyanate.

The present invention also comprises a method of producing unit charges according to the invention, which comprises the steps of:

(a) impregnating grains of nitrocellulose powder with up to 7%, based on the weight of nitrocellulose, of the gelatinising plasticiser so as to cause the latter to be completely absorbed by the nitrocellulose grains without agglomerating the nitrocellulose grains, (b) stabilising the impregnated grains by allowing them to stand at ambient temperature for at least one day (up to several tens of days), optionally after sieving and graphitising of the grains which may be carried out a few days after the impregnation, (c) charging the stabilised grains into a mould maintained at a temperature from 70° to 95° C., preferably about 80° C., preheating the grains and then compression moulding at a pressure of 120 to 1,000 (preferably 300–500) bars at the above temperature, cooling and releasing the unit charge thus obtained from the mould, and (d), optionally, heat treating the unit charge after it has been cooled and released from the mould.

If the gelatinising plasticiser is a diisocyanate, it is preferred that step (b) should be carried out for no longer than 10 days, preferably from 2 to 3 days, while if the plasticiser is a polyester, it is preferred that step (b) should be carried out for at least 10 days, preferably up to several tens of days.

Unit charges according to the invention have several advantages. In particular, they have a potential energy which is only a little below that of pure nitrocellulose. Thus, unit charges of potential energy as high as 950 calories per gram can be obtained using nitrocellulose having a nitrogen content of 13.2%, which when pure has a potential energy of 1000 calories per gram, without the need to incorporate energetic agents, such as nitroglycerine, into the charges.

In contrast, if the amount of gelatinising plasticiser were to be greater than 7% based on the weight of the nitrocellulose (not according to the invention) the potential energy drops substantially. Thus, with 20% of triacetin, the potential energy of the unit charge does not exceed 600 calories/gram.

Furthermore, unit charges according to the invention fragment and burn instantly, like a loose powder, while unit charges containing more than 7% of plasticiser fragment badly and fragmentation becomes worse as the plasticiser content increases. If the plasticiser content reaches a certain high level, the unit charge burns only gradually along a flame front and large pieces of unburnt material can result showing that the charge burns as a block and not as a loose powder.

Because of the fragmentation of unit charges according to the invention during combustion, gas evolution therefrom is better distributed than from comparative charges.

Unit charges according to the invention need no energetic agents, such as nitroglycerin, as mentioned above. The grains of nitrocellulose can therefore be dry during moulding, which facilitates handling (particularly weighing and mould-filling) and higher moulding pressures can be used.

When comparing unit charges according to the invention with known unit charges containing a thermosetting resin binder, the charges according to the invention are found to have a much higher thermal dimensional stability and a longer storage life before moulding.

Finally, unit charges according to the invention contain a much larger amount of explosive propellant in a given volume than loose nitrocellulose powder does.

In order that the invention may be more fully understood, the following examples are given by way of illustration only.

EXAMPLE 1

A powder of non-smoothed, non-graphitised nitrocellulose grains, having a nitrogen content of 13.2%, and containing 1% of diphenylamine as a stabiliser and 0.3% of $K_2SO_4$ as a flash inhibitor, in which the grains were of tubular shape, of 1.15 mm external diameter, 0.15 mm internal diameter and 1.3 mm length, was mixed with a small proportion (3.5% based on the weight of the nitrocellulose powder) of triacetin until the triacetin had been completely absorbed by the nitrocellulose powder grains. The resulting grains of powder were kept separate from one another so as to avoid agglomeration.

The powder impregnated with triacetin was sieved, 24 hours after mixing, through a sieve with a square 2 mm mesh, to remove any possible aggregates.

The sieved powder was then graphitised (treated with graphite) so as to facilitate slip of the grains of powder over one another and to ensure the reproducibility of subsequent charging into a mould, and hence ballistic reproducibility.

The powder was then stabilized by standing for three days at ambient temperature so that the grains were no longer tacky, but were thoroughly dry. 65 g of the powder were introduced into a mould and heated to 80° C. over a period of 15 minutes.

A conventional mould was used, the mould comprising a cylindrical tubular body, two pistons forming the top and the bottom of the mould, movement of the pistons being controlled by hydraulic actuators and a central core, the ends of which were engaged in axial bores in the pistons. The mould was provided with a heating or cooling fluid circulating system, and had a coating of a mould release agent on all its internal surfaces.

The heated powder was compressed in the mould for a period of 15 minutes at a temperature of 80° C. and a pressure of 500 bars.

The resulting block, whilst still under pressure, was cooled in the mould, released from the mould and heated for 48 hours at about 70° C.

A 65 g hollow cylindrical unit charge which was suitable for 30 mm calibre ammunition was obtained.

A number of samples of such charges were mounted in 30 mm metal cases to form shells weighing 236 g, which were fired from a gun by means of an electrical fuse and 1.5 g of a priming charge in the central channel of the charge, which served to ignite the charge and initiate its fragmentation.

The following results were obtained:

number of discharges: 6 mean maximum pressure: 3108 bars (measured by means of a piezoelectric sensor).

Velocity measured at 25 m from the mouth of the gun: 869 m/sec.

The potential energy of this unit charge was 950 calories/gram, compared with 1,000 calories/gram for loose nitrocellulose powder.

By way of comparison a 30 mm shell with the same priming charge, fuse and case, was only able to contain 52 g of loose nitrocellulose powder, because of the volume taken up by voids.

This comparative shell, when tested in the same way as the shells according to the invention, gave the following results:

mean maximum pressure: 3000 bars (measured by a piezo-electric sensor).

Velocity measured at 25 m from the mouth of the gun: 790 m/sec.

EXAMPLE 2

The procedure of forming a unit charge described in Example 1 was repeated, except that a powder of non-smoothed, graphitised nitrocellulose grains, having a nitrogen content of 13.2% and containing 1% of diphenylamine as a stabiliser, the grains being of tubular shape, of 1.22 mm length, 0.82 mm external diameter and 0.17 mm internal diameter, was used, and the triacetin was replaced by diacetin in an amount of 5% based on the weight of the nitrocellulose powder.

The resulting hollow cylindrical unit charge, weighing 65 g, was mounted in a 30 mm metal case to form a shell weighing 236 g, which was fired from a gun by means of an electrical fuse and 0.3 g of a priming charge in the central channel of the charge.

The following results were obtained:

means maximum pressure (measured by a piezoelectric sensor): 2830 bars.

Velocity measured at 25 m from the mouth of the gun: 846 m.

The potential energy of this unit charge was 930 calories/gram.

EXAMPLES 3 to 5

These examples relate to the manufacture of unit charges according to the invention with the plasticisers indicated in the following table, using the nitrocellulose powder employed in Example 2 and the procedure described in Example 1, except that the sieving stage was omitted, solid cylindrical blocks of 30 mm diameter were manufactured, and the stabilization time and the weight of the blocks were varied as shown in the following table.

These unit charges had comparable properties to those of Example 1 and Example 2.

| Example | Plasticiser | Plasticiser content based on the weight of powder | Weight of block | Stabilisation time | Height of the cylinder |
|---|---|---|---|---|---|
| 3 | Formrez 15/22* | 5% | 20 g | 15 days | 23 mm |
| 4 | Mixed carbonate of allyl alcohol and of diethylene | 5% | 20 g | 3 days | 23 mm |

-continued

| Example | Plasticiser | Plasticiser content based on the weight of powder | Weight of block | Stabilisation time | Height of the cylinder |
|---|---|---|---|---|---|
| 5 | glycol Hexamethylene diisocyanate | 3% | 65 g | 3 days | 75 mm |

*Formrez 15/22 is a poly(glycol adipate) marketed by Witco Chemical Co.

What is claimed is:

1. A unit charge of propellant powder, of potential energy essentially as pure nitrocellulose, free of energetic agents and free of thermosetting resin binders, capable of fragmenting and burning instantly, which consists essentially of grains of nitrocellulose agglomerated together by means of a gelatinizing plasticizer for said nitrocellulose, said plasticizer causing the ordered structure of the nitrocellulose to disappear irreversibly at a temperature between 40° and 100° C., said plasticizer having a melting point of up to 80° C. and being in an amount between 3 and 7% based on the weight of said nitrocellulose.

2. A unit charge according to claim 1, wherein said plasticizer is a low molecular weight ester of glycerol.

3. A unit charge according to claim 2, wherein said glycerol ester is selected from the group consisting of glycerol mono-, di- and tri-acetate.

4. A unit charge according to claim 1, wherein said plasticizer is a polyester having free hydroxyl groups and a molecular weight of less than 1500 which is derived from a polyol of short chain length.

5. A unit charge according to claim 4, wherein said polyester is derived from a dibasic acid selected from the group consisting of adipic acid and succinic acid.

6. A unit charge according to claim 1, wherein said plasticizer is an organic carbonate.

7. A unit charge according to claim 6, wherein said carbonate is ethylene glycol diallylcarbonate.

8. A unit charge according to claim 1, wherein said plasticizer is a telechelic aliphatic diisocyanate.

9. A unit charge according to claim 8, wherein said diisocyanate is hexamethylene diisocyanate.

10. A unit charge according to claim 1 wherein the plasticizer is liquid at a temperature up to 80° C.

11. A unit charge according to claim 1 which has a potential energy of up to 950 calories per gram with a nitrocellulose of nitrogen content 13.2%, wherein the plasticizer is triacetin in an amount of 3.5%.

* * * * *